United States Patent [19]

Jackson

[11] Patent Number: 4,751,914

[45] Date of Patent: Jun. 21, 1988

[54] ATMOSPHERIC GAS BURNER

[75] Inventor: Barry N. Jackson, Woodbury, Minn.

[73] Assignee: Ecodyne Corporation, St. Paul, Minn.

[21] Appl. No.: 1,809

[22] Filed: Jan. 8, 1987

[51] Int. Cl.[4] ..... F24H 1/00

[52] U.S. Cl. ..... 126/361; 431/349; 431/326

[58] Field of Search ..... 126/361; 431/349, 354, 431/355, 329, 326

[56] References Cited

U.S. PATENT DOCUMENTS

| | | | |
|---|---|---|---|
| 3,575,543 | 4/1971 | Weatherston | 431/349 X |
| 4,293,297 | 10/1981 | Polidoro | 431/349 X |
| 4,301,772 | 11/1981 | Eising | 126/361 X |
| 4,541,410 | 9/1985 | Jatana | 126/361 X |
| 4,545,329 | 10/1985 | Adams | 126/361 X |

OTHER PUBLICATIONS

Bray Technologies, PLC; Leicester Place, Leeds LS29BBH.

*Primary Examiner*—Larry Jones

*Attorney, Agent, or Firm*—Neuman, Williams, Anderson & Olson

[57] ABSTRACT

An improved burner for heating water in a hot water system is provided. This burner includes an inlet tube having flared ends and a constricted middle portion to provide an increased amount of air into the barrier. The burner also includes a barrel which communicates with the inlet tube to receive fuel gas and air from it. It vents this air and fuel gas mixture through a large number of ports formed through its sidewalls and arranged in a predetermined pattern to produce a continuous combustion layer when the user ignites the venting mixture. These ports have a width substantially smaller than their length and they produce small, nonluminous, bluish flames which form the combustion layer. This combustion layer burns hot to raise the temperature of the barrel segments surrounding the ports to a level at which the segments glow red and emit infrared heat.

6 Claims, 1 Drawing Sheet

FIG. 1
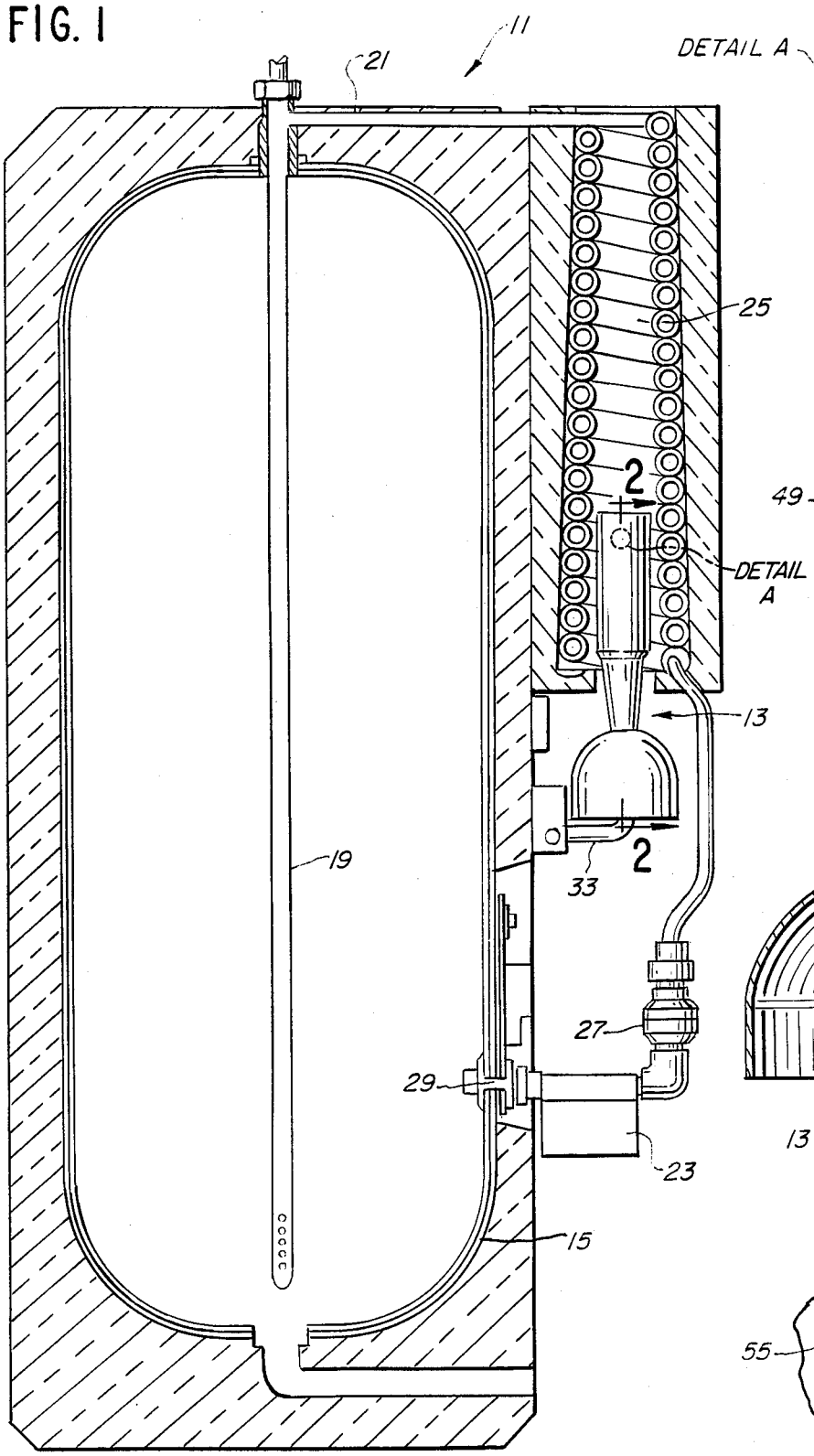
FIG. 2
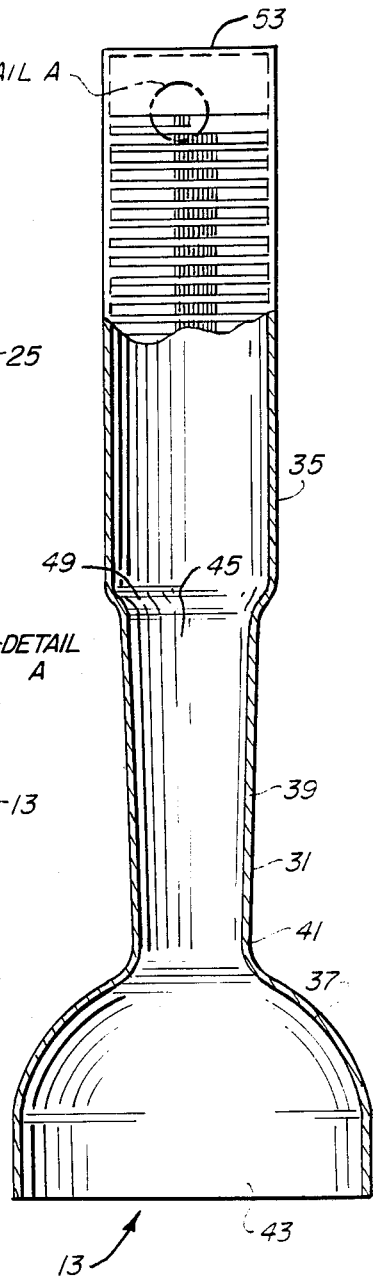
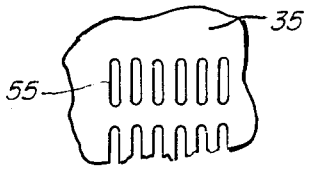
FIG. 3

ATMOSPHERIC GAS BURNER

BACKGROUND OF THE INVENTION

1. Field of the Invention

The present invention relates to an improved atmospheric gas burner used to heat the water supplied by a hot water system. More particularly, the invention relates to an improved burner which increases the amount of air which a burner pre-mixes with fuel gas and which vents the resulting mixture through a large number of ports. The mixture burns outside of these ports in small, nonluminous, bluish flames which form a thin combustion layer and which heats the burner housing around the ports so that it glows red hot and radiates infrared heat.

2. Description of the Prior Art

Atmospheric gas burners which heat the water supplied by hot water systems, as well as those used in other applications, produce at least one flame which gives off energy, usually in the form of light and heat as a result of rapid chemical reaction between a combustible gas and air, oxygen, or any other oxidizing agent. Generally, this flame includes two identifiable segments. In one segment the fuel gas and air mixture undergoes a rapid chemical reaction. This portion of the flame is predominantly nonluminous and bluish, and it becomes hotter as the proportion of air or oxygen increases. In the second segment excess fuel gas reacts with the oxygen of the surrounding air.

To maximize the heat emitted by a flame, the amount of air pre-mixed with the fuel gas must be sufficient to burn most of the fuel gas, i.e., the amount of air must be such that it minimizes the second segment of the flame. In addition, the flame must not contact any object which might interrupt the combustion of the fuel gas and air mixture.

The heating capability of a burner increases if, in addition to the heat it produces by chemical reaction, i.e., combustion, it can produce radiant heat. This type of heat is energy in the form of waves or particles released when nuclear changes occur in a material. To produce radiant heat, a burner must bring one of its material components up to a temperature at which the material glows red hot.

The improved burner of the present invention meets the criteria outlined in the text above; and it greatly increases the heat produced with respect to the fuel consumed. It produces a combustion layer formed by a large number of predominantly small, nonluminous, bluish flames. In addition, the burner housing below this combustion layer radiates infrared heat which supplements the heat produced by the burning fuel gas and air mixture.

The improved burner of the present invention comprises a housing including an inlet tube with a first dome-shaped end and a second flaring end connected by a constricted middle portion forming a throat. The dome-shaped end of the tube is the inlet opening of the burner through which fuel gas and air flow into the burner. The configuration of the inlet tube provides a "Venturi effect" which produces suction at the inlet opening to increase the flow of air into the burner. The dome-shaped inlet is much larger than the opposite flaring end segment, so that the burner may receive a large amount of air. The opposite or second end of the inlet tube communicates with a barrel.

The barrel is an enclosure which has an opening in communication with the inlet tube to receive the air and fuel gas mixture. It also includes a large number of ports through which it vents the mixture for burning. The size of these ports and their arrangement produces a corresponding number of small flames to form a thin, bluish, nonluminous combustion layer which emits heat and which raises the temperature of the portion of the barrel around the ports to a temperature at which this portion glows red and radiates infrared heat.

SUMMARY OF THE INVENTION

It is a general object of this invention to provide an improved atmospheric gas burner for heating the water supplied by a hot water system.

It is another object of the present invention to provide an improved burner which produces a thin combustion layer formed by a large number of small predominantly nonluminous, bluish flames.

It is another object of this invention to provide an improved burner which increases the proportion of air or oxygen in the gas mixture burned and which provides a surface which radiates infrared heat to greatly increase the heat production of the burner.

Other objects, advantages and features of the present invention will become apparent upon reading the following detailed description and appended claims, and upon reference to the accompanying drawings.

In the preferred embodiment of the present invention, an improved burner provides an increased amount of heat for heating the water supplied by a hot water system. This burner includes a housing with an inlet tube which receives air and fuel gas. The inlet tube has a first dome or bell shaped end segment and a second flaring end segment connected by a constricted middle portion forming a throat. This configuration produces a "Venturi effect" and accordingly, suction through the inlet opening at the first end segment of the tube where the air and fuel gas flow into the tube. The inlet tube dome-shaped end segment is substantially larger than the second flaring end segment to increase the supply of air for the burner.

The burner housing also includes a barrel which has an opening through which it receives the air and fuel gas from the second end segment of the inlet tube. The barrel is an annular enclosure which has a large number of ports formed through its sidewalls.

In the preferred embodiment, the burner housing is a one-piece, integral unit. However, the housing may comprise separate inlet tube and barrel segments welded or otherwise secured together.

The barrel ports are small openings through which the burner vents the fuel gas and air mixture for burning. The width of each port is substantially smaller than the length; and the ports form a predetermined pattern, e.g., a number of individual rows, a single helix, or any other suitable pattern which produces a continuous combustion layer when the user ignites the mixture escaping from the ports. This combustion layer heats the barrel segment surrounding the ports so that the housing glows red hot and radiates infrared heat which greatly increases the burner's heat production. The individual flames at each port which form the combustion layer are small, nonluminous and bluish flames that consume most of the fuel gas to minimize reaction with the surrounding air.

Preferably, the burner comprises components made of stainless steel. Alternatively, one may construct the burner using other metallic materials, nonmetallic materials, or any material which radiates infrared heat upon heating and which does not deteriorate with repeated heating and cooling.

BRIEF DESCRIPTION OF THE DRAWINGS

For a more complete understanding of this invention, one should now refer to the embodiment illustrated in greater detail in the accompanying drawings and described below by way of an example of the invention. In the drawings:

FIG. 1 is a sectional view of a hot water system in which the burner of the present invention heats the water supplied by the system.

FIG. 2 is a sectional view of the burner of the present invention.

FIG. 3 is an enlarged view of detail A in FIG. 2.

While the following text describes the invention in connection with a preferred embodiment, one should understand that the invention is not limited to this embodiment. Furthermore, one should understand that the drawings are not necessarily to scale.

DETAILED DESCRIPTION OF THE DRAWINGS AND THE PREFERRED EMBODIMENT

Turning now to the drawings, FIG. 1 shows a hot water system generally at 11, including the burner of the present invention 13 which heats the water supplied by the system. The system includes a pressure vessel 15. This vessel 15 is a cylindrical tank capable of containing various fluids at high pressures and temperatures. It comprises a hollow shell having an elongate cylindrical body and substantially hemispherically shaped top and bottom portions. It communicates with a fresh, cold water source (not shown) through a three-way pipe connection which also connects the cold water source and the vessel 15 with a conduit 21.

To heat the water contained in the pressure vessel or the water flowing into the system 11 from the fresh water source, a pump 23 induces flow of the water through the conduit 21, including heat exchanger coil segment 25, through the check valve 27, and into the vessel 15 through a port 29 at the bottom of the vessel. In this manner, the system continues moving the water until all the water contained by the pressure vessel has reached a predetermined temperature. Co-pending U.S. application Ser. No. 001808 of 1-8-87, entitled "Improved Hot Water System with Atmospheric Gas Burner", and assigned to the assignee of the present application, discloses the system 11 in greater detail and generally discloses the burner 13. With this reference, the applicant intends to incorporate the disclosure of the cited co-pending application to the present disclosure.

The burner 13 is a one-piece, integral structure which lies vertically alongside the pressure vessel 15. It includes an annular inlet tube 31 which receives a portion of the surrounding air and fuel gas from a conduit 33. It also includes a barrel 35 which vents the air and fuel gas for burning. This barrel 35 extends into the bottom end of the central opening of the heat exchanger coil 25 where it heats the coil and the water which flows through it.

Turning now to FIG. 2, the inlet tube 31 of the improved burner has a first domed end segment 37, and a second flaring and frustoronical end segment 39 disposed at opposite ends of the tube along the tube's longitudinal axis and connected by a constricted middle portion or throat 41. The tube opening 43 at the end segment 37 serves as the inlet opening for the burner. This opening 43 has a substantially greater diameter than the tube's opposite opening 45 so that the tube may receive an increased amount of air. To further increase the amount of air drawn by the burner, the inlet tube has the configuration of a Venturi tube, as described, for producing suction at the inlet opening 43. The conduit 33, delivers fuel gas to the inlet tube 31 through opening 43, and the fuel gas and air flow through the tube into the barrel 35.

The barrel 35 is a round, tubular structure. This shape allows the burner to effectively heat the coil 25. For other applications, however, the barrel may have any other suitable shape. One end of this barrel has an opening 49 through which the barrel communicates with the opening 45 of the inlet tube end segment 39. An end wall 53 closes the end of the tube opposite the end which communicates with the inflow tube.

The barrel includes a plurality of ports 55 disposed in a predetermined configuration. FIG. 2 shows the ports disposed in a helix and spaced circumferentially, a constant distance from each other around the barrel. However, any other configuration, e.g., individual rows, which produces a continuous combustion layer when the user ignites the gas mixture venting through the ports is suitable. These ports 55 have a width substantially smaller than their length. (See FIG. 3) They are also very small in size in comparison to the surface area of the barrel.

Preferably, the burner is made out of stainless steel. However, any other suitable material which radiates infrared heat upon heating and which does not deteriorate with repeated heating and cooling may be a suitable substitute.

By way of a specific example, an improved burner 13 of inexpensive construction is usable in the hot water system 11 shown in FIG. 1. The burner has an inlet tube with a diameter of 4 inches at the intake end and 1.5 inches at the opposite end. Its constricted throat portion 41 has a diameter of 1.27 inches. The burner's barrel 35 has a length of 6⅛ inches and a diameter of 2 inches. It includes ports spaced 0.038 inches apart and arranged in a helix which begins approximately 0.3 inches from the distal end of the barrel and has a pitch of approximately 1.28°. The barrel includes 1825 ports, each having a width of approximately 0.026 inches and a length of approximately 0.130 inches.

In operation, the burner 13 receives air and fuel gas through the inlet tube 31. The mixture moves through the inlet tube 31, into the barrel 35 and out of the barrel through the small ports 55. Upon ignition of the venting mixture, nonluminous bluish flames burn at each port and these flames combine to form a thin combustion layer around the burner. Since the burner provides a sufficient amount of air for nearly complete combustion of the fuel gas, these flames burn very hot. Consequently the barrel material circumjacent these ports glows red hot and radiates infrared heat which supplement the heat provided by the chemical reaction of the burning mixture.

Thus, the applicant has provided an improved burner for heating the water supplied by a hot water system. The burner includes an inlet tube having a configuration which produces suction at the end which serves as an air inlet for the burner. The air and fuel gas which the tube receives flows through the tube and into a barrel through and opening in the barrel. This barrel has a plurality of ports formed through its sidewalls which vent the air and fuel gas mixture for burning at the outer surface of the barrel.

While the applicant has shown one embodiment of the invention, one will understand, of course, that the invention is not limited to this embodiment since those skilled in the art to which the invention pertains may make modifications and other embodiments of the principles of this invention, particularly upon considering the foregoing teachings. For example, one skilled in the art may construct the burner housing using separate inlet tube and barrel segments welded or otherwise secured together. The applicant, therefore, by the appended claims, intends to cover any such modifications and amendments as incorporate those features which constitute the essential features of this invention.

What is claimed is:

1. An atmospheric gas burner for receiving air and fuel gas and venting the air and fuel gas for burning, said burner comprising: an inlet tube having a first dome shaped end segment and a second flared end segment and a constricted middle portion forming a throat, said inlet tube having a first opening at said first end segment and a second opening at said second opposite end segment, said first dome shaped end segment adapted to receive fuel gas and a large volume flow of air to facilitate burning; and a barrel secured to said inlet tube, said barrel having an opening in communication with said second flared end segment of said inlet tube and a plurality of ports disposed in circumferentially spaced relation around said barrel and forming a predetermined configuration, said ports having a width substantially smaller than their length and venting the air and fuel gas mixture which flows from said inlet tube to said barrel for forming upon ignition of the venting air and fuel gas at said ports a thin combustion layer of small, nonluminous, bluish flames around said barrel, said combustion layer heating the segments of said barrel disposed adjacent said ports to a temperature at which said segments radiate infrared heat.

2. The burner of claim 1, wherein said inlet tube and said barrel have an annular configuration.

3. The burner of claim 2, wherein said first opening of said inlet tube has a substantially greater diameter than said opening at said second end.

4. The burner of claim 2, wherein said ports are arranged in individual rows around said barrel.

5. The burner of claim 2, wherein said ports are arranged in a helix around said barrel.

6. An improved hot water system including an elongate pressure vessel and heat exchanger means disposed proximate the pressure vessel in fluid communication with the pressure vessel, wherein the improvement comprises: an atmospheric gas burner disposed proximate said pressure vessel and said heat exchanger means, in heat exchange relation with said heat exchanger means, said burner receiving air and fuel gas, venting said air and fuel gas for burning, and having: an inlet tube with a first dome shaped segment and a second flared end segment, said end segments disposed at opposite ends of said inlet tube along the longitudinal axis of said inlet tube, said inlet tube also having a constricted middle portion forming a throat and a first opening at said first end segment and a second opening at said second opposite end segment, said first opening receiving fuel gas and air; and an elongate barrel secured to said inlet tube, said barrel having an opening in communication with said second flared end segment of said inlet tube and a plurality of ports disposed in circumferentially spaced relation around said barrel and forming a predetermined configuration, said ports having a width substantially smaller than their length and venting the air and fuel gas which flows from said inlet tube to said barrel for forming upon ignition of the air and fuel gas at said ports a thin combustion layer of small, nonluminous bluish flames around said barrel, said combustion layer heating the segments of said barrel disposed adjacent said ports to a temperature at which said segments radiate infrared heat, said longitudinal axis of said barrel being substantially coaxial with said longitudinal axis of said inlet tube and substantially parallel to the longitudinal axis of said pressure vessel.

* * * * *